US008146254B2

(12) United States Patent
Morisugi et al.

(10) Patent No.: US 8,146,254 B2
(45) Date of Patent: Apr. 3, 2012

(54) HAIR CLIPPER

(75) Inventors: Kazuhiro Morisugi, Inukami-gun (JP); Seiko Yabuuchi, Hikone (JP); Toshio Ikuta, Hikone (JP); Hitoshi Ogawa, Inukami-gun (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 656 days.

(21) Appl. No.: 11/762,443

(22) Filed: Jun. 13, 2007

(65) Prior Publication Data

US 2007/0289144 A1 Dec. 20, 2007

(30) Foreign Application Priority Data

Jun. 16, 2006 (JP) ..... 2006-167942

(51) Int. Cl.
*B26B 19/02* (2006.01)

(52) U.S. Cl. ..... 30/43.92; 30/216; 30/220

(58) Field of Classification Search ..... 30/216, 30/43.92, 43–43.6, 43.7–43.9, 210, 220, 30/196

See application file for complete search history.

(56) References Cited

U.S. PATENT DOCUMENTS

| | | | | |
|---|---|---|---|---|
| 3,111,755 | A | 11/1963 | Futterer et al. | |
| 3,589,007 | A * | 6/1971 | Walton | 30/140 |
| 3,962,785 | A | 6/1976 | Poel | |
| 4,395,821 | A | 8/1983 | Schweingruber | |
| 5,819,415 | A * | 10/1998 | Bruggers et al. | 30/223 |
| 6,260,276 | B1 * | 7/2001 | Lebherz et al. | 30/201 |
| 6,490,798 | B2 | 12/2002 | Morisugi et al. | |
| 6,964,614 | B1 | 11/2005 | Tsai | |
| 7,249,416 | B2 | 7/2007 | Yamaguchi et al. | |
| 7,340,839 | B2 * | 3/2008 | Oh | 30/210 |
| 7,426,785 | B2 * | 9/2008 | Ho | 30/43.92 |
| 7,624,506 | B2 * | 12/2009 | Melton et al. | 30/216 |
| 2002/0056199 | A1 * | 5/2002 | Laube | 30/216 |
| 2007/0022605 | A1 | 2/2007 | Morisugi et al. | |
| 2008/0052914 | A1 * | 3/2008 | Bednar | 30/216 |

FOREIGN PATENT DOCUMENTS

| | | |
|---|---|---|
| GB | 1079798 | 8/1967 |
| JP | 56 1188 | 1/1981 |
| JP | 2004-531294 A | 10/2004 |
| JP | 2005-304627 A | 11/2005 |
| WO | 02/055272 | 7/2002 |

OTHER PUBLICATIONS

English language Abstract of JP 2005-304627 A.

* cited by examiner

*Primary Examiner* — Sean Michalski
(74) *Attorney, Agent, or Firm* — Greenblum & Bernstein P.L.C.

(57) ABSTRACT

A hair clipper (1) comprises a replaceable blade block (3) having a comb-shaped stationary blade (5) and a comb-shaped moving blade (6) which is reciprocally movable in a widthwise direction of the hair clipper (1), a main body (2) having a motor (8) and a driving member (14) to transfer and to transmit a driving force of the motor (8) to reciprocal motion of the moving blade (6), and to which the blade block (3) is detachably attached, and a pressing mechanism (4) to press the moving blade (6) toward the stationary blade (5). The pressing mechanism (4) is provided on the main body (2) and has at least one contact portion (**4*b*) which reciprocally moves in synchronism with a reciprocal motion of the moving blade (6**).

9 Claims, 20 Drawing Sheets

HAIR CLIPPER

BACKGROUND OF THE INVENTION

1. Field of the Invention

The present invention relates to a hair clipper having a comb-shaped stationary blade and a comb-shaped moving blade to cut hairs by clipping between the stationary blade and the moving blade with pressing the moving blade toward the stationary blade by a spring.

2. Description of the Related Art

A conventional hair clipper generally comprises a blade block with a comb-shaped stationary blade and a comb-shaped moving blade to cut hairs, a main body including a motor and a driving mechanism to transfer the driving force to reciprocation of the moving blade, and a pressing spring to press the moving blade toward the stationary blade so as to cut the hairs well.

Conventionally, a pressing spring to press the moving blade to the stationary blade is installed in the blade block. Therefore, a number of elements that constitute the replaceable blade block becomes larger, and it causes the reduction of assemble workability and the increase of the cost of the blade block. In particular, in the use of barber shop with high frequency of usage or in the medical use where the razor must be disposed essentially, it is required to reduce the running cost of the replaceable blade block of the hair clipper.

Japanese Laid-Open Patent Publication No. 56-1188 discloses a structure to install a pressing spring on a main body of a hair clipper. In such a conventional structure, the pressure of the pressing spring, however, is always applied to a blade holder through the moving blade, and a reaction force from the blade holder always acts on the pressing spring in reverse. When the blade block is stocked in a long term under the condition that the reaction force acts on the blade spring, fatigue or compression buckling may occur in the pressing spring in the term of stock due to the reaction force, and thus, the sharpness of the blade may be decreased. Furthermore, when the moving blade is reciprocated frequently, a large friction force occurs between the moving blade and the pressing spring, so that the pressing spring may be galled or deformed due to the friction force, and thereby the life of the blade block may be shortened. Still furthermore, pressing point of the moving blade by the pressing spring may be varied due to the galling or deformation of the pressing spring, so that the pressing force of the pressing spring may be varied. Consequently, the sharpness of cutting by the moving blade and the stationary blade becomes unstable, and desired sharpness of the cutting blade cannot be obtained.

Alternatively, it is assumed that a contact portion of the pressing spring is stationary engaged with the moving blade so as to remove the friction between the contact portion of the pressing spring and the moving blade. When the moving blade is stopped at an end of the reciprocal motion not the center, the contact portion of the pressing spring is held in a state that the contact portion is pulled in an oblique direction. That is, a tension in the oblique direction acts on the contact portion of the pressing spring further to the pressure to press the moving blade toward the stationary blade and the reaction force thereof, simultaneously. Under such a condition, when the blade block is stocked in a ling term, fatigue and/or deformation of the pressing spring may occur in the term of stock so that it causes the deterioration of the sharpness of cutting.

SUMMARY OF THE INVENTION

The present invention is perceived to solve the above mentioned problems of the conventional hair clipper, and an object of the present invention is to provide a hair clipper having a replaceable blade block which enables to maintain the sharpness of cutting of blades in a long term, to reduce the cost of the replaceable blade block, and to increase assemble workability.

A hair clipper in accordance with an aspect of the present invention comprises:

a blade block having a comb-shaped stationary blade and a comb-shaped moving blade which is reciprocally movable in a widthwise direction of the hair clipper;

a main body having a motor and a driving member to transfer and to transmit a driving force of the motor to reciprocal motion of the moving blade, and to which the blade block is attached; and a pressing mechanism to press the moving blade toward the stationary blade, provided on the main body and having at least one contact portion which reciprocally moves in synchronism with a reciprocal motion of the moving blade.

According to such a configuration, since the pressing mechanism is provided on the main body not on the detachable blade block, a number of elements that constitute the replaceable blade block can be decreased, so that assemble workability of the blade block is increased and the cost of the blade block can be decreased. In particular, in the use of barber shop with high frequency of usage or in the medical use where the razor must be disposed essentially, it is possible to reduce the running cost of the replaceable blade block of the hair clipper. Furthermore, since the pressing mechanism is not provided on the blade block, even when the blade block is stocked in a long term, the sharpness of cutting of the blade is never be deteriorated due to fatigue or deformation of the pressing spring. Still furthermore, since the contact portion of the pressing mechanism reciprocally moves in synchronism with the reciprocal motion of the moving blade, the contact portion of the pressing mechanism rarely moves relative to the moving blade, and thus, slipping friction between the contact portion of the pressing mechanism and the moving blade rarely occurs. Consequently, galling or deformation of the element of the pressing mechanism rarely occurs, so that the pressing force of the pressing mechanism is maintained evenly. The sharpness of cutting of the blades becomes stable, and desired sharpness of the cutting blade can be obtained.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DETAILED DESCRIPTION OF THE EMBODIMENT

First Embodiment

A hair clipper having a replaceable blade block in accordance with a first embodiment of the present invention is described with reference to the drawings.

Figure 1:
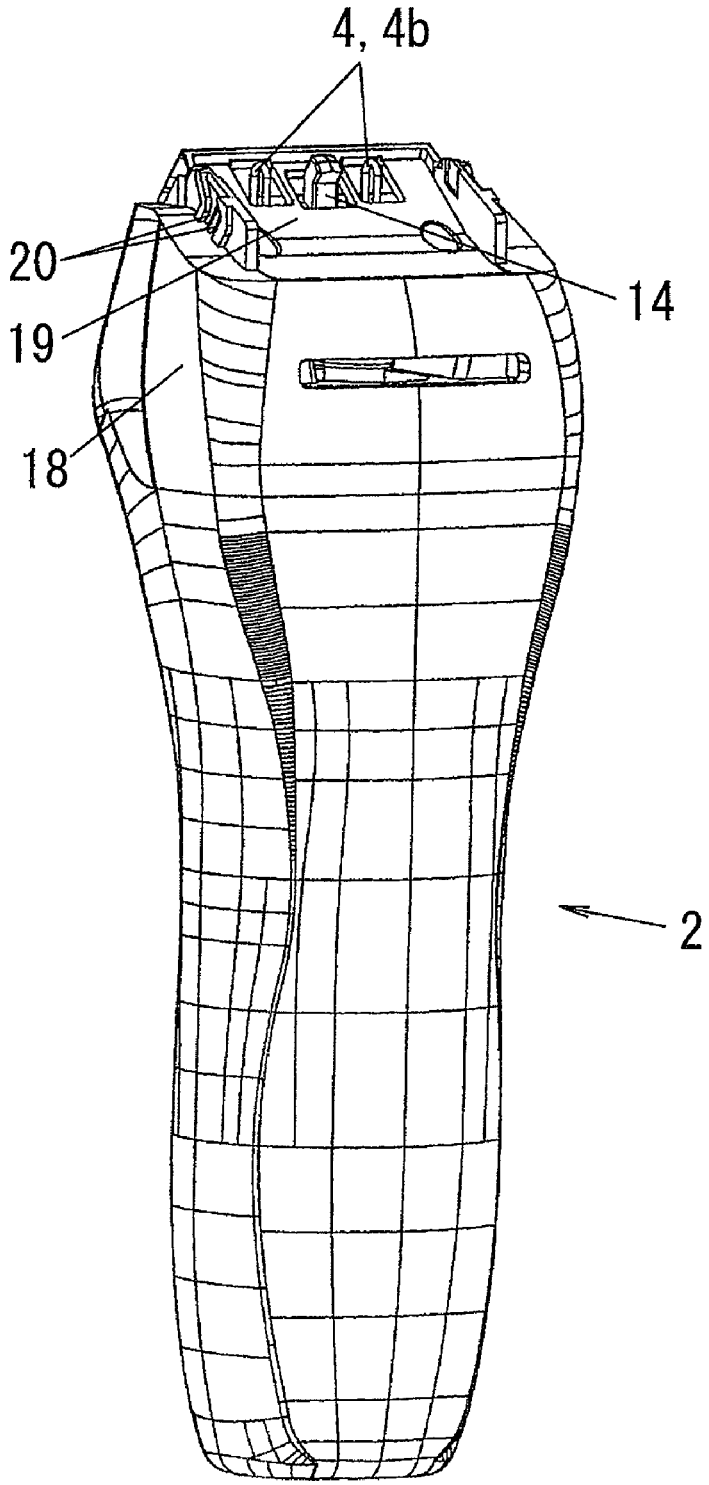
FIG. 1 is a perspective view showing an appearance of a main body of a hair clipper in accordance with a first embodiment of the present invention.
Figure 2C:
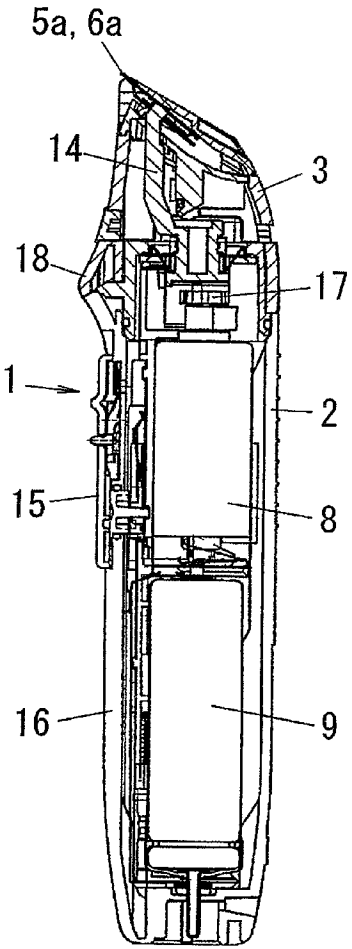
FIG. 2C is a side sectional view showing an inner configuration of the hair clipper.
Figure 2B:
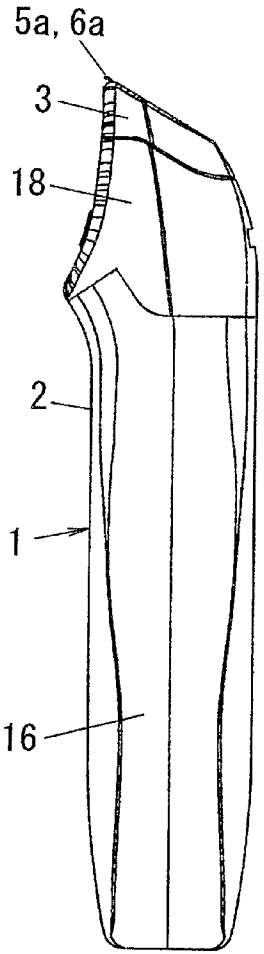
FIG. 2B is a side view of the hair clipper.
Figure 2A:
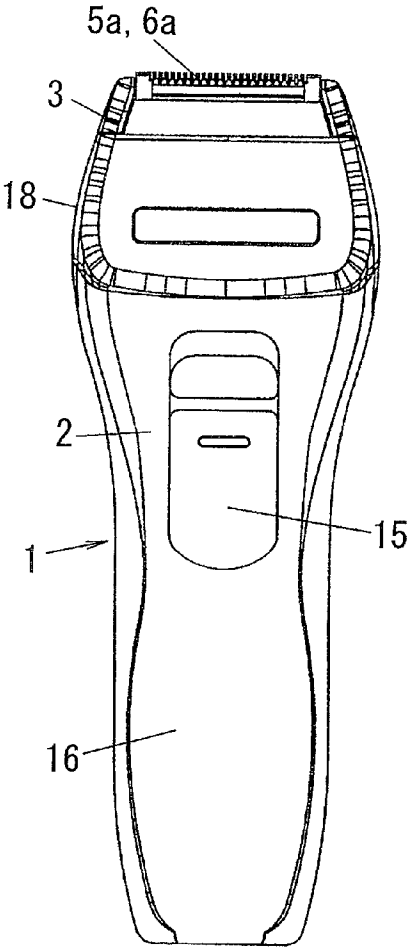
FIG. 2A is a front view of the hair clipper in the first embodiment.
Figure 3:
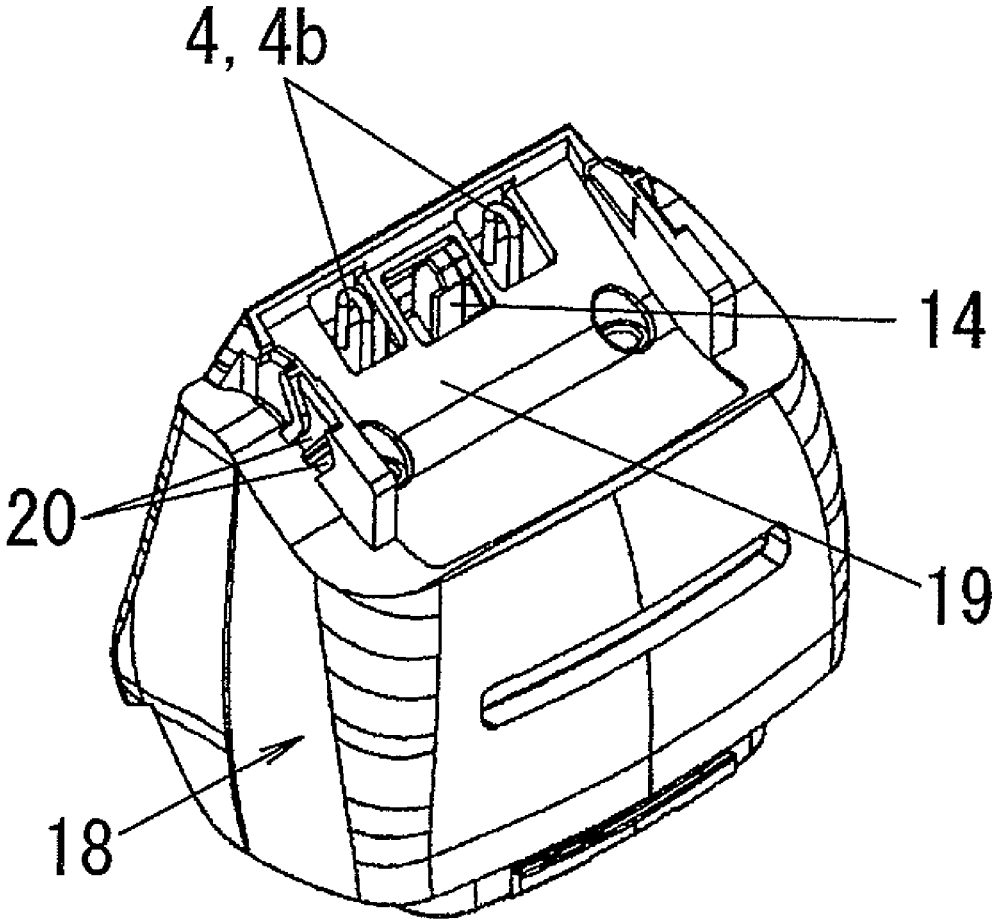
FIG. 3 is a perspective view showing a configuration of a blade holder with a pressing spring which is to be installed on the main body of the hair clipper in the first embodiment.
Figure 4B:
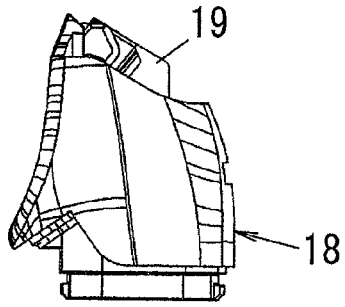
FIG. 4B is a side view of the blade holder.
Figure 4A:
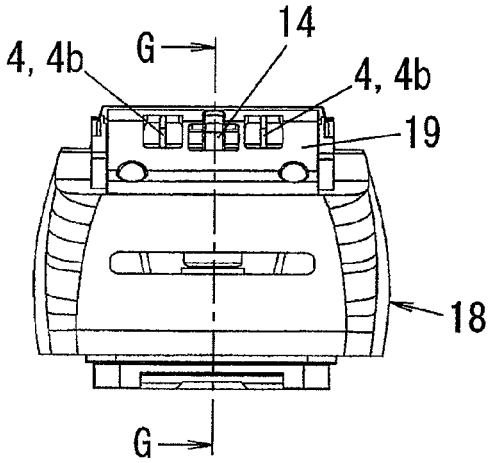
FIG. 4A is a front view of the blade holder in the first embodiment.
Figure 4C:
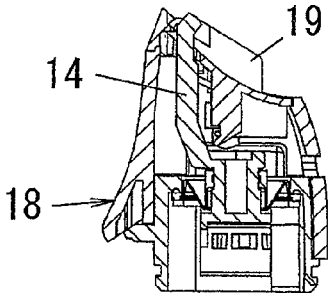
FIG. 4C is a sectional side view showing an inner configuration of the blade holder cut along a G-G line in FIG. 4A.

FIG. 1 shows an appearance of a main body 2 of a hair clipper in the first embodiment. FIGS. 2A and 2B show an entire appearance of the hair clipper 1 with a blade block 3 attached to the main body 2. FIG. 2C shows an inner configuration of the hair clipper 1.

Figure 5:
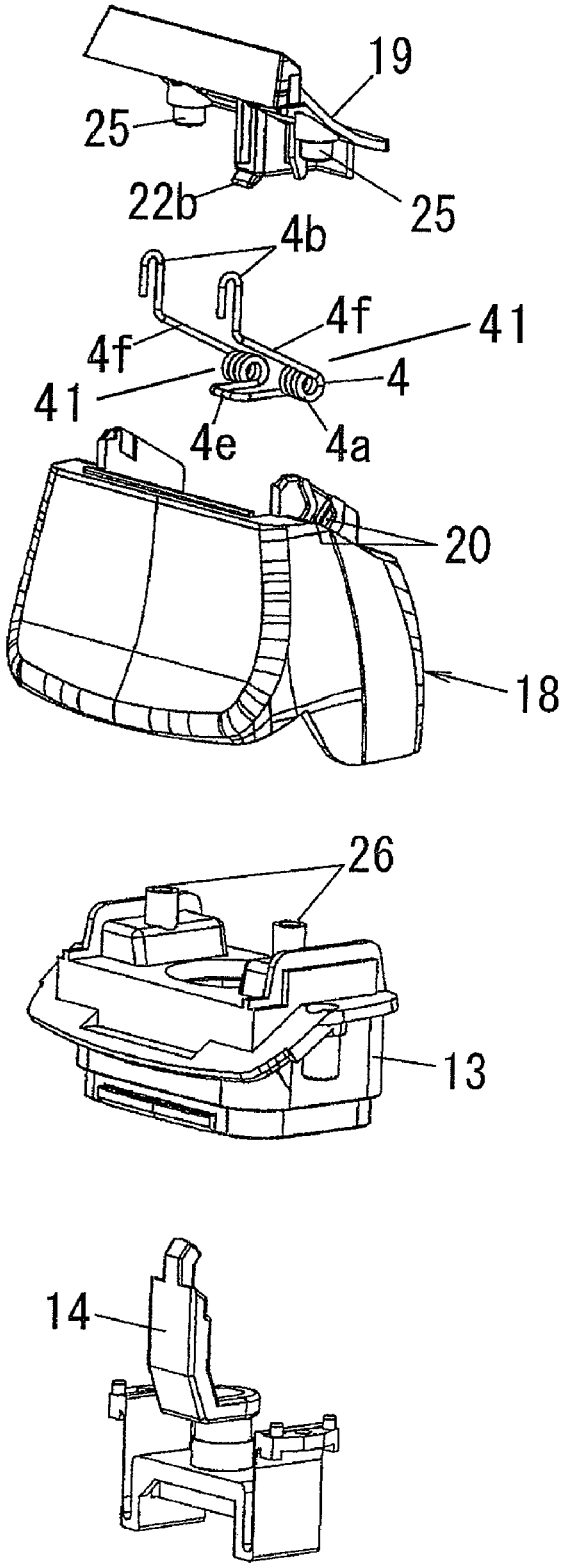
FIG. 5 is an exploded perspective view showing a configuration of the blade holder in the first embodiment.

The hair clipper 1 is comprised of the blade block 3 having a comb-shaped stationary blade 5 and a comb-shaped moving blade 6 to cut hairs, the main body 2 having a driving member 14 which transforms and transmits a driving force of a motor 8 to a reciprocal motion of the moving blade 6, and a pressing mechanism 4 having a pair of contact portions 4*b* which contact with the moving blade 6 to press the moving blade 6 toward the stationary blade 5. In the first embodiment, the pressing mechanism 4 is comprised of a pair of torsion springs 41, as shown in FIG. 5, for example.

The main body 2 contains the motor 8 and a secondary battery 9 in a housing 16. The driving member 14 is attached to a driving shaft of the motor 8 via an eccentric cam 17. A switch knob 15 is provided on a front face of the housing 15. When the switch knob 15 is operated to move above, the power switch of the hair clipper 1 is turned on so that electric power is supplied to the motor 8 from the battery 9, and thus, the moving blade 6 is reciprocally driven in a predetermined direction, for example, a widthwise direction of the hair clipper 1 by the driving force of the motor 8 through the eccentric cam 17 and the driving member 14, continuously.

Figure 6:
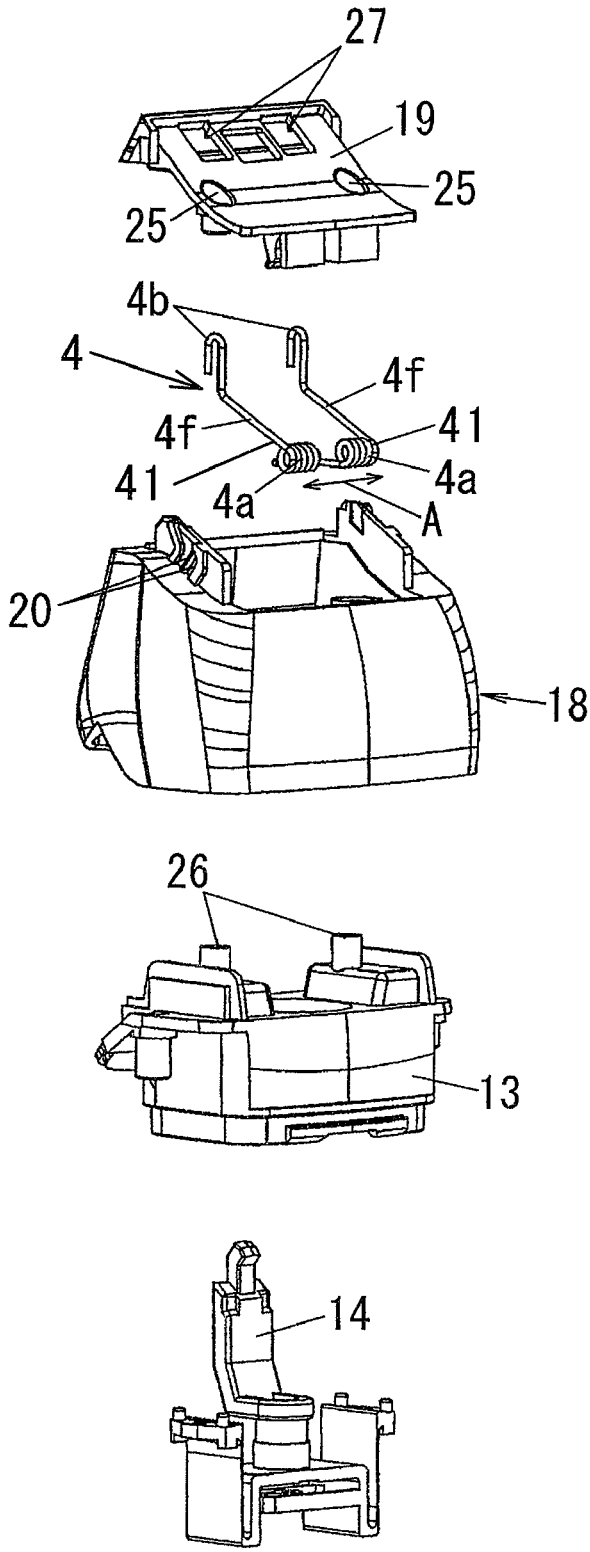
FIG. 6 is an exploded perspective view showing the configuration of the blade holder watched in a different direction from that in FIG. 5.

A blade holder 18 (of the main body 2) is detachably installed at a top end portion of the main body 2, as shown in FIG. 1. Detailed configuration of the blade holder 18 is described. As shown in FIGS. 5 and 6, the driving member 14 and a driving base 13 are installed inside the blade holder 18, and a head cover 19 (of the main body 2) is provided at an upper open end of the blade holder 18, as shown in FIG. 1. The head cover 19 serves as a holder to hold the pressing mechanism 4 and to prevent incoming of cut pieces of hairs into the inside of the blade holder 18.

A pair of blade block holders 20 arranged in an anteroposterior direction of the hair clipper is formed at each side of the upper open end of the blade holder 18 in a widthwise direction of the hair clipper 1. The blade block 3 is detachably attached to the blade block holders 20 of the blade holder 18.

When the head cover 19 is fit into the upper open end of the blade holder 18, and the driving base 13 is installed inside the blade holder 18, center axes of screw holes 25 of the head cover 19 coincide with center axes of screw holes 26 of the driving base 13. Under such a state, a pair of screws is screwed into the screw holes 25 and 26, so that the head cover 19 and the driving base 13 are integrally fixed on the blade holder 18.

Figure 7A:
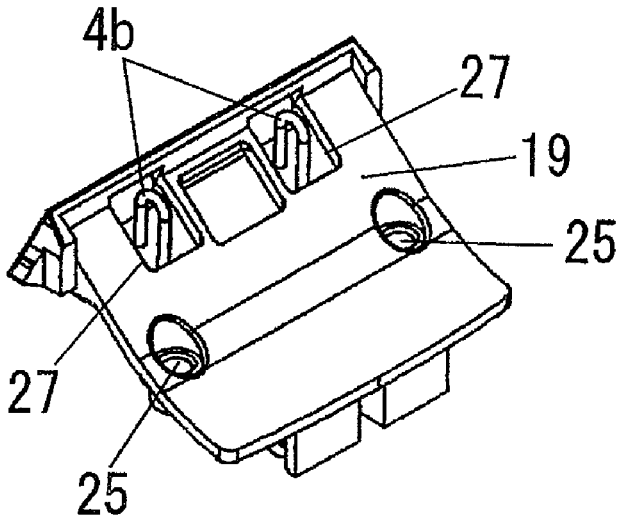
FIG. 7A is a perspective view showing a head cover of the blade holder watched from above in the first embodiment.
Figure 7B:
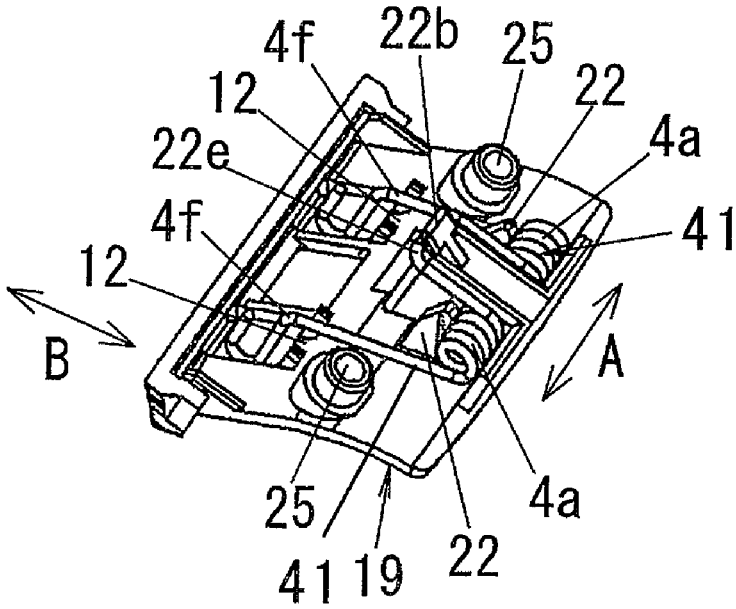
FIG. 7B is a perspective view of the head cover watched from below.

As shown in FIG. 7B, a pair of spring holders 22 to hold the torsion springs 41 of pressing mechanism 4 is formed to protrude downward from a bottom face of the head cover 19. The winding portions 4*a* of the torsion springs 41 are formed at both ends of a coupling portion 4*e* having a substantially U-shape with corners of right angle so that center axes of the winding portions 4*a* of the torsion springs 41 are oriented in the same direction shown by arrow A in FIG. 6 or FIG. 7B. An arm 4*f* of each torsion spring 41 is protruded from an end of the winding portion 4*a* in a direction shown by arrow B in FIG. 7B which is perpendicular to the direction shown by arrow A. A free end of each arm 4*f* is formed to have a substantially U-shape and serves as a contact portion 4*b* to contact with the moving blade 6 and to press the moving blade 6 toward the stationary blade 5. Since a wire material of the torsion spring 41 has a circular section, the curved portion of the U-shape of the contact portion 4*b* is substantially finished spherical. The spherically finished contact portion 4*b* contacts an engaging portion 10 of the moving blade 6 shown in FIG. 11, for example, the details of which will described later.

Figure 8A:
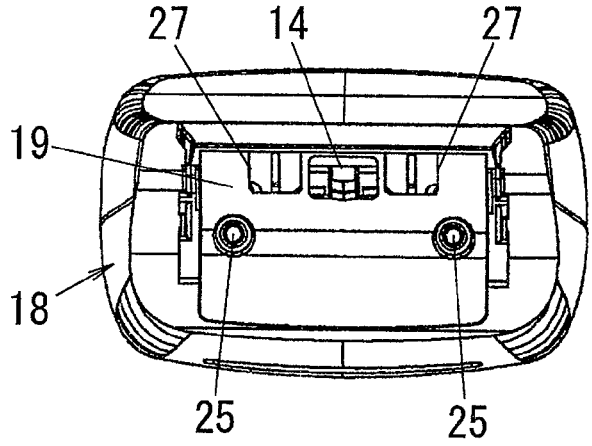
FIG. 8A is a plane view of the blade holder in the first embodiment.
Figure 8B:
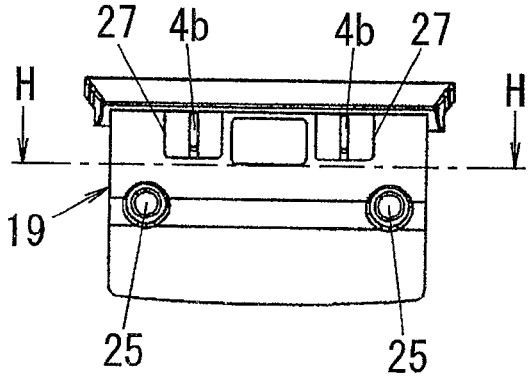
FIG. 8B is a front view of the of the head cover.
Figure 10B:
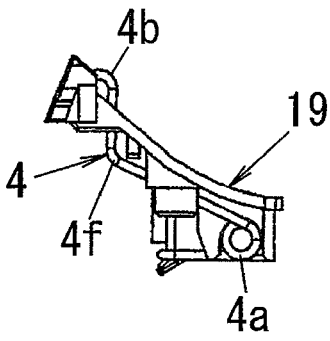
FIG. 10B is a sectional side view showing an inner configuration of the head cover.
Figure 10A:
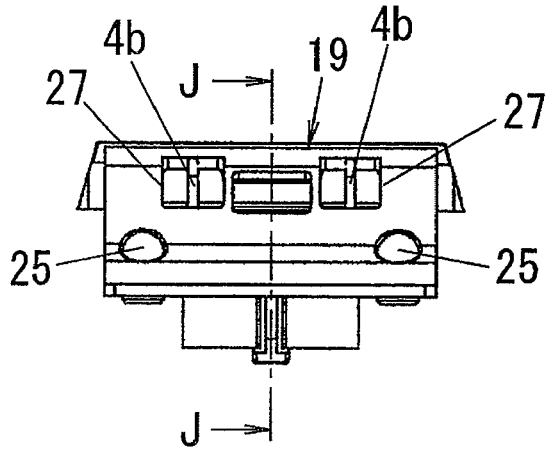
FIG. 10A is a front view of the head cover in the first embodiment.
Figure 10C:
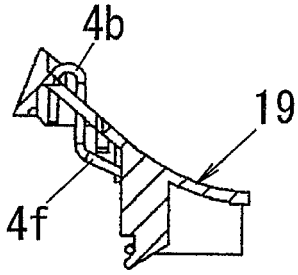
FIG. 10C is a sectional side view of the head cover cut along a J-J line in FIG. 10A.

The spring holder 22 of the head cover 19 holds the winding portions 4*a* of the torsion springs 41 in the direction shown by arrow A which is parallel to the reciprocal moving direction of the moving blade 6. The spring holder 22 has a pair of stoppers 22*a* formed to face ends of winding portions 4*a* of the torsion springs 41 in the widthwise direction shown by arrow A so as not to move the winding portions 4*a* in the widthwise direction, and a hook 22*b* to which the substantially U-shaped coupling portion 4*e* between the torsion springs 41 is hooked so as not to rotate the winding portions 4*a* of the torsion springs 41 around the center axes thereof. Thus, the pressing mechanism 4, that is, the torsion springs 41 is/are held on the head cover 19 in a manner so that the contact portions 4*b* are protruded above from openings 27 formed on the head cover 19, as shown in FIG. 10B, for example. In addition, the sizes of the openings 27 of the head cover 19 are set so as not to interrupt the reciprocal motion of the contact portions 4*b* of the pressing mechanism 4 as shown in FIG. 8B, for example.

Figure 8C:
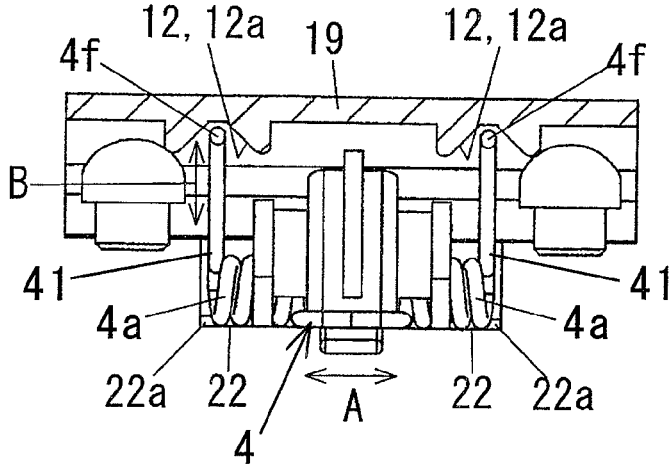
FIG. 8C is a sectional plain vies of the head cover cut along an H-H line in FIG. 8B.
Figure 9:
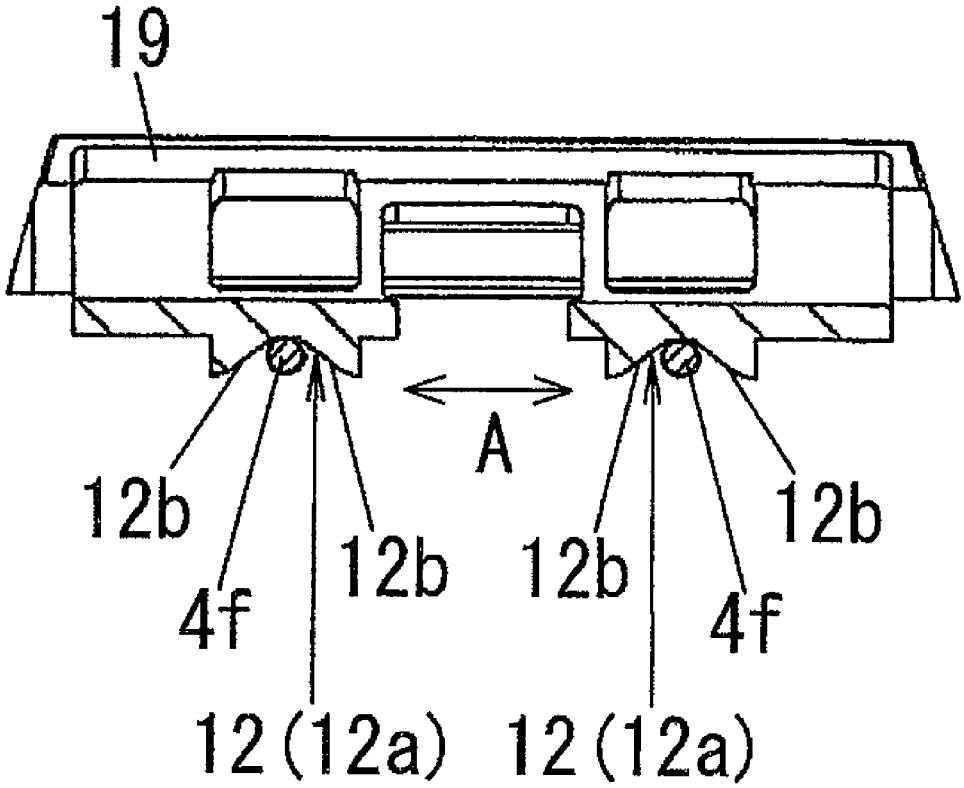
FIG. 9 is a partially sectional front view of the heard cover showing a configuration for positioning the pressing spring provided on a rear face of the head cover in the first embodiment.

As shown in FIGS. 8C and 9, a pair of positioning portions 12 is formed on the bottom face of the head cover 19 so as to position the arms 4*f* of the torsion springs 41. Each positioning portion 12 has a recesses 12*a* having a symmetrical inclined planes 12*b*. By fitting the arms 4*f* of the torsion springs 41 into the recesses 12*a*, the arms 4*f* are positioned between the inclined planes 12*b*, and thus, the contact portions 4*b* of the pressing mechanism 4 can be coupled with the engaging portions 10 of the moving blade 6 when the blade block 3 is attached to the main body 2 of the hair clipper 1.

Figure 11:
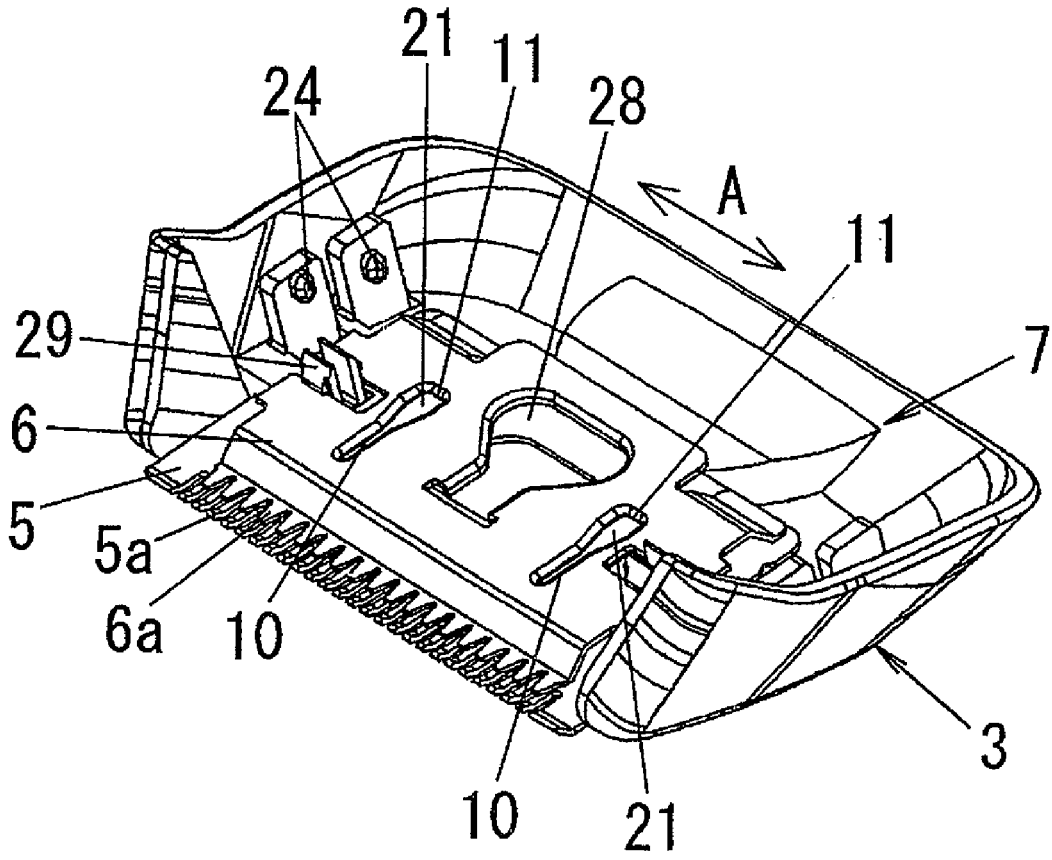
FIG. 11 is a perspective view showing a configuration of a bottom face side of a blade block in the first embodiment.
Figure 12:
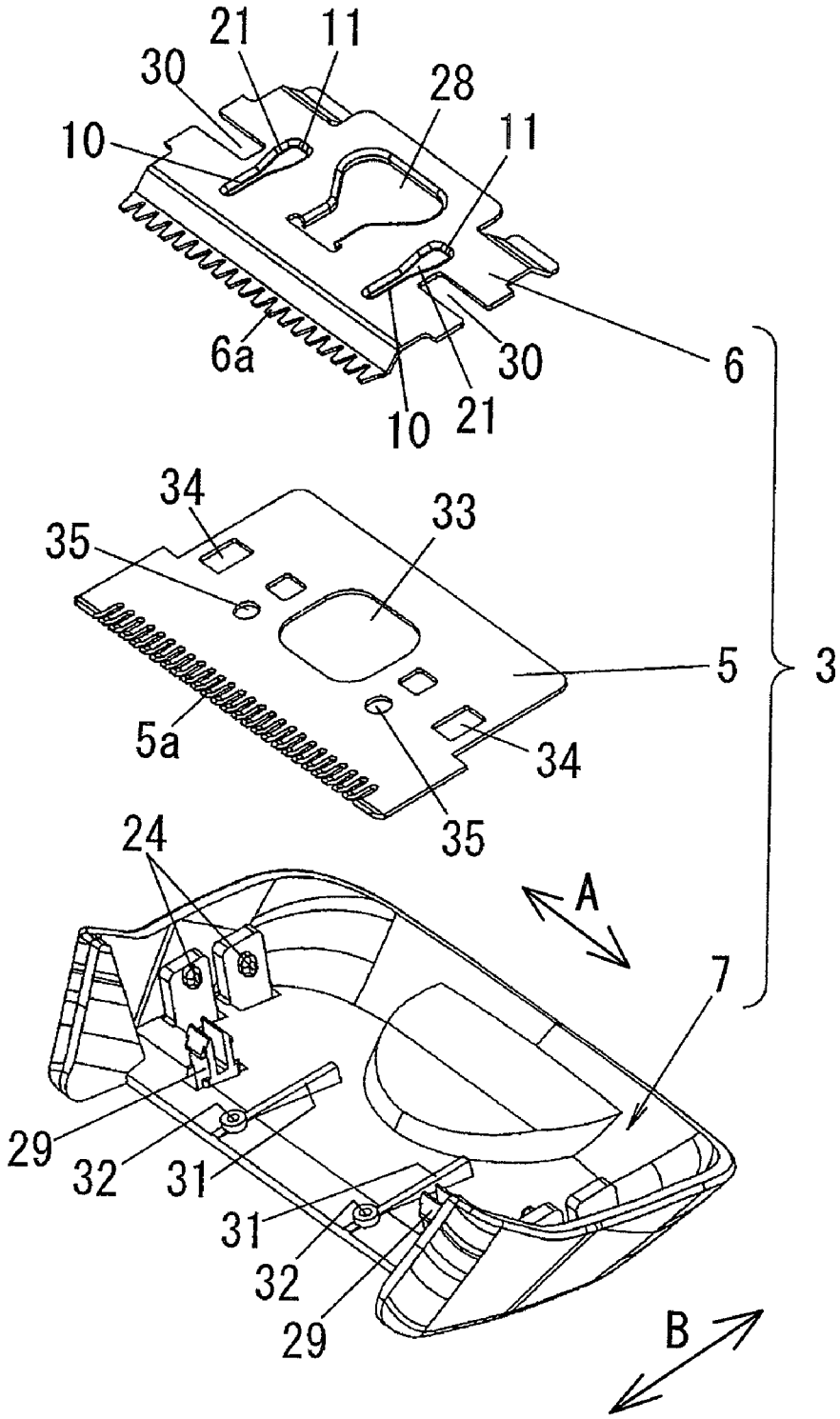
FIG. 12 is an exploded perspective view showing a configuration of the blade block in the first embodiment.

Subsequently, the details of the blade block 3 are described with reference to FIGS. 11 and 12. The blade block 3 is comprised of the stationary blade 5, the moving blade 6 and a blade base 7 to which the stationary blade 5 and the moving blade 6 are attached. The stationary blade 5 is fixed on the blade base 7 and the moving blade 6 is disposed below the stationary blade 5 so as to be moved reciprocally.

A pair of posts 24 each having a hooking protrusion is formed at each side on a bottom face of the blade base 7 in the direction shown by arrow A, which is hooked with blade block holders 20 of the blade holder 18 so that the blade block 3 is detachably attached to the blade holder 18 on the main body 2 of the hair clipper 1.

A pair of guide protrusions 29 to guide the reciprocal motion of the moving blade 6 is formed on the bottom face of the blade base 7 at positions in the vicinity of a front end in the anteroposterior direction shown by arrow B and in the vicinity of both sides in the widthwise direction shown by arrow A. Furthermore, a pair of stationary blade holders 31 to hold the stationary blade 5 and a pair of screw holes 32 to which screws to fix the stationary blade 5 on the blade base 7 are screwed.

The stationary blade 5 has a center through hole 33 into which a top end portion of the driving member 14 is inserted freely movable therein with an allowance, a pair of fitting holes 34 which is fit to the guide protrusions 29 on the blade base 7, and a pair of screw holes through which the screws penetrate, respectively formed at both sides of the center through holes 33 in the widthwise direction. The stationary blade 5 has saw-teeth 5*a* formed on a front end thereof in the anteroposterior direction.

The moving blade 6 has a center engaging hole 28 with which the top end portion of the driving member 14 is detachably engaged, a pair of recesses 21 formed at both sides of the center engaging hole 28 in the widthwise direction, and a pair of guide grooves 30 which is formed at both sides in the widthwise direction and slidably engaged with the guide protrusions 20 on the blade base 7. Each recess 21 has the engaging portion 10 disposed at anterior and having a predetermined width a little narrower than a diameter of a wire rod for the torsion springs 41 and a guide portion 11 disposed at posterior and having a width wider than that of the engaging portion 10 in the widthwise direction. The moving blade 6 has saw-teeth 6*a* formed on a front end thereon in the anteroposterior direction. As shown in FIG. 12, the front end, that is, the saw-teeth 6*a* and the rear end of the moving blade 6 are stepped to reduce the contacting area to the stationary blade 5.

When the blade block 3 is attached to the blade holder 18 of the main body 2, the contact portions 4*b* of the pressing mechanism 4 held on the blade holder 18 are coupled with the engaging portions 10 of the moving blade 6, and the top end portion of the driving member 14 is engaged with the center engaging hole 28 of the moving blade 6. When the moving blade 6 is reciprocally driven by the driving force of the motor 8 through the driving member 14, the contact portions 4*b* of the pressing mechanism 4 are reciprocally moved in synchronism with the reciprocal motion of the moving blade 6. The pressure of the torsion springs 41 of the pressing mechanism 4 is applied to the moving blade 6 at the contacting points of the contact portions 4*b* and the engaging portions 10 of the moving blade 6. Even when the moving blade 6 is reciprocally driven, the contacting points of the contact portions 4*b* and the engaging portions 10 rarely move, so that the pressure of the pressing mechanism 4 to press the moving blade 6 toward the stationary blade 5 is applied substantially at the same points. Furthermore, the contacting points of the contact portions 4*b* rarely moves relative to the engaging portions 10 of the moving blade 6, even when the moving blade 6 is reciprocally driven, so that friction force rarely occurs between the contacting points of the contact portions 4*b* of the pressing mechanism 4 and the engaging portions 10 of the moving blade 6. Thus, the contact portions 4*b* of the pressing mechanism 4 are rarely galled or deformed due to the friction force between the contacting portions 4*b* of the pressing mechanism 4 and the moving blade 6, and thereby the life of the blade block 3 may not be shortened.

Figure 13A:
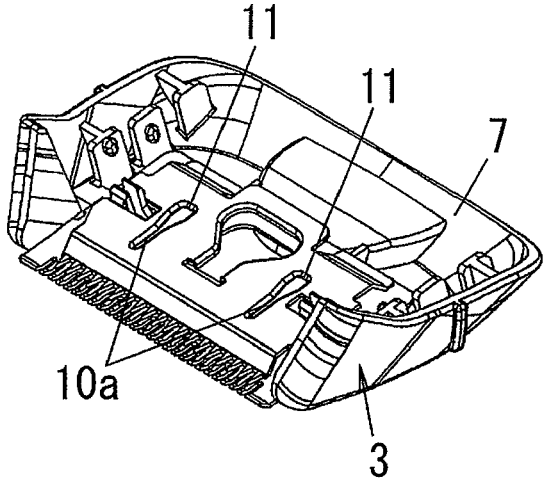
FIG. 13A is a perspective view showing a first example of a configuration of an engaging portion of a moving blade to which a contact portion of the pressing spring is engaged in the first embodiment.
Figure 13B:
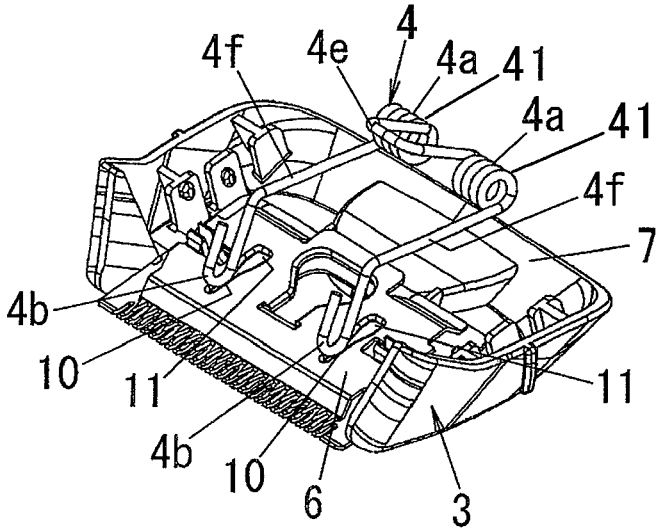
FIG. 13B is a perspective view showing a configuration that the pressing spring is engaged with the moving blade in the first example.
Figure 13C:
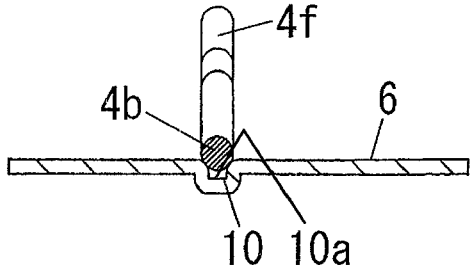
FIG. 13C is a sectional view showing a detailed configuration of the engaging portion of the moving blade with the pressing spring in the first example.

FIGS. 13A to 13C show a first example of the engaging portion 10 of the moving blade 6 and the contact portion 4*b* of the torsion spring 41 of the pressing mechanism 4. In the first example, the engaging portion 10 of the moving blade 6 has a bottom 10*a* as mentioned above. Since the engaging portion 10 and the guide portion 11 are merely recessed, the mechanical strength of the moving blade 6 is rather increased. The contact portion 4*b* of the torsion spring 4*a* of the pressing mechanism 4 is formed substantially U-shape, so that mechanical rigidity of the contact portion 4*b* is increased, and thus, deformation of the contact portion 4*b* in brushing to remove the cut pieces of hairs can be prevented.

Figure 14A:
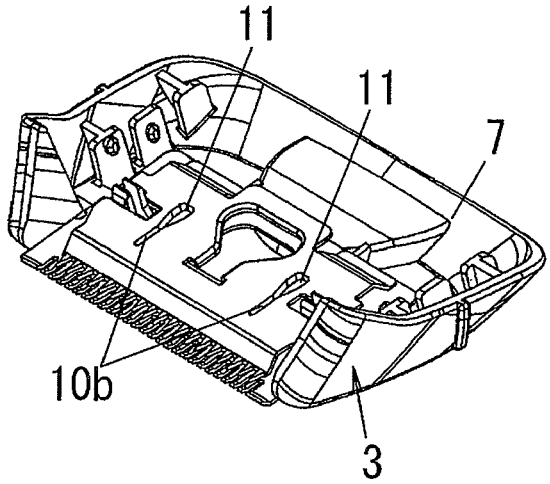
FIG. 14A is a perspective view showing a second example of a configuration of an engaging portion of a moving blade to which a contact portion of the pressing spring is engaged in the first embodiment.
Figure 14B:
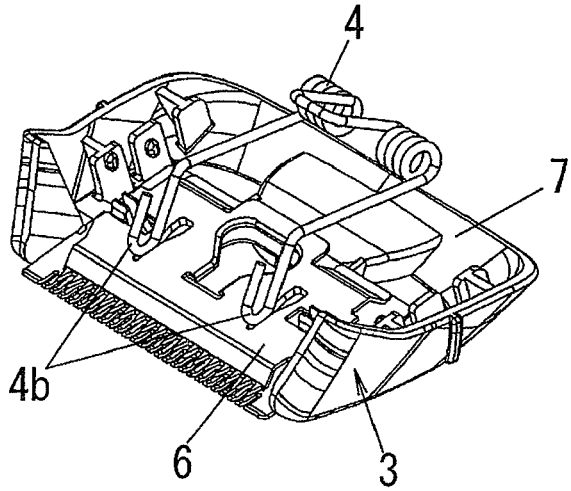
FIG. 14B is a perspective view showing a configuration that the pressing spring is engaged with the moving blade in the second example.
Figure 14C:
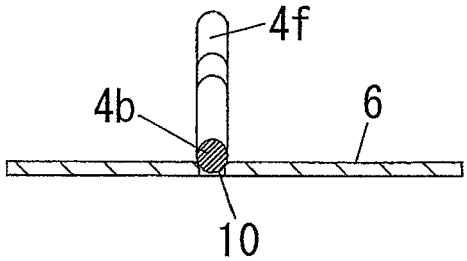
FIG. 14C is a sectional view showing a detailed configuration of the engaging portion of the moving blade with the pressing spring in the second example.

FIGS. 14A to 14C show a second example of the engaging portion 10 of the moving blade 6 and the contact portion 4*b* of the torsion spring 41 of the pressing mechanism 4. In the second example, the engaging portion 10 of the moving blade 6 is a slit with no bottom face, and the contact portion 4*b* of the pressing mechanism 4 is formed to have a substantially U-shape, similar to the first example. Since the contact portion 4*b* of the torsion spring 4*a* of the pressing mechanism 4 is formed substantially U-shape, mechanical rigidity of the contact portion 4*b* is increased, and thus, deformation of the contact portion 4*b* in brushing to remove the cut pieces of hairs can be prevented.

Figure 15A:
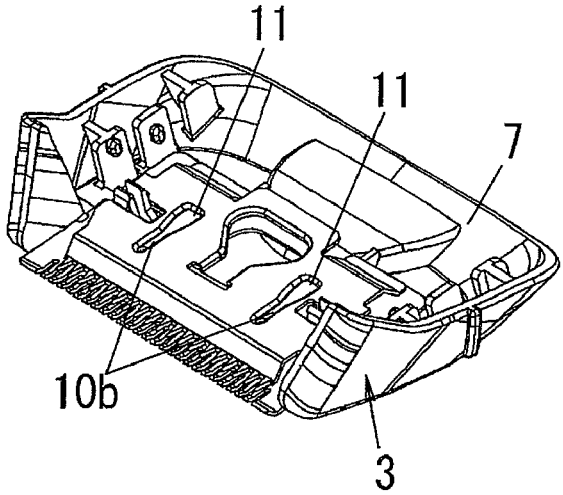
FIG. 15A is a perspective view showing a third example of a configuration of an engaging portion of a moving blade to which a contact portion of the pressing spring is engaged in the first embodiment.
Figure 15B:
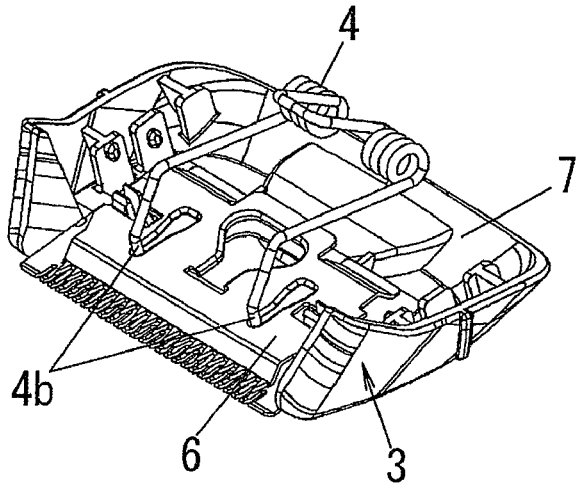
FIG. 15B is a perspective view showing a configuration that the pressing spring is engaged with the moving blade in the third example.
Figure 15C:
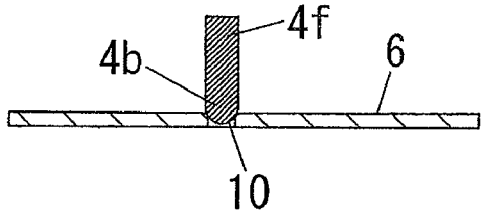
FIG. 15C is a sectional view showing a detailed configuration of the engaging portion of the moving blade with the pressing spring in the third example.

FIGS. 15A to 15C show a third example of the engaging portion 10 of the moving blade 6 and the contact portion 4*b* of the torsion spring 41 of the pressing mechanism 4. In the third example, the engaging portion 10 of the moving blade 6 is a slit with no bottom face, and the contact portion 4*b* of the pressing mechanism 4 is formed to have a substantially L-shape and the top end of the contact portion 4*b* is finished to be spherical.

Figure 16A:
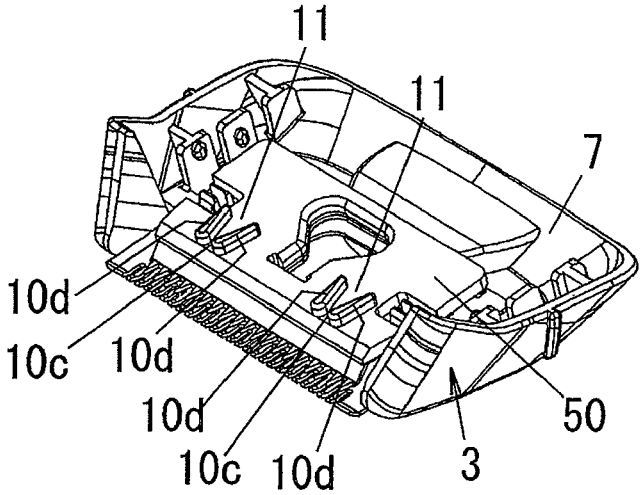
FIG. 16A is a perspective view showing a fourth example of a configuration of an engaging portion of a moving blade to which a contact portion of the pressing spring is engaged in the first embodiment.
Figure 16B:
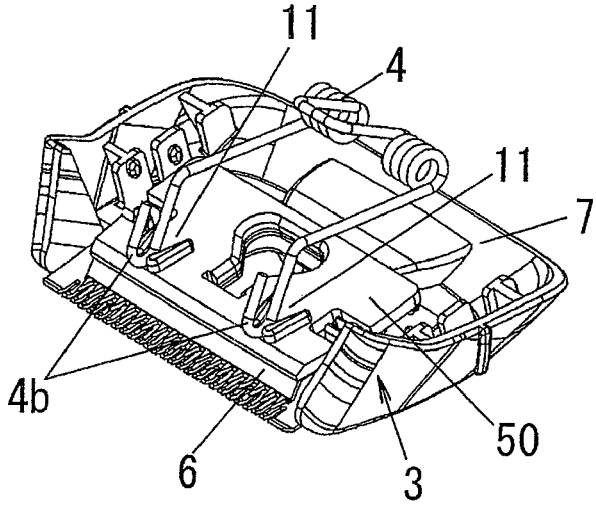
FIG. 16B is a perspective view showing a configuration that the pressing spring is engaged with the moving blade in the fourth example.
Figure 16C:
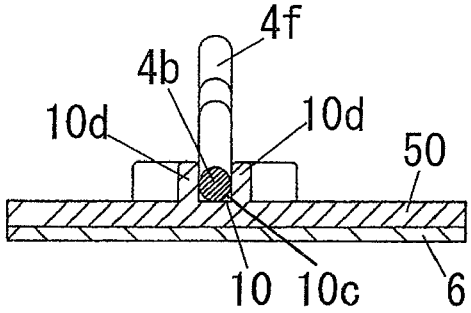
FIG. 16C is a sectional view showing a detailed configuration of the engaging portion of the moving blade with the pressing spring in the fourth example.
Figure 17:
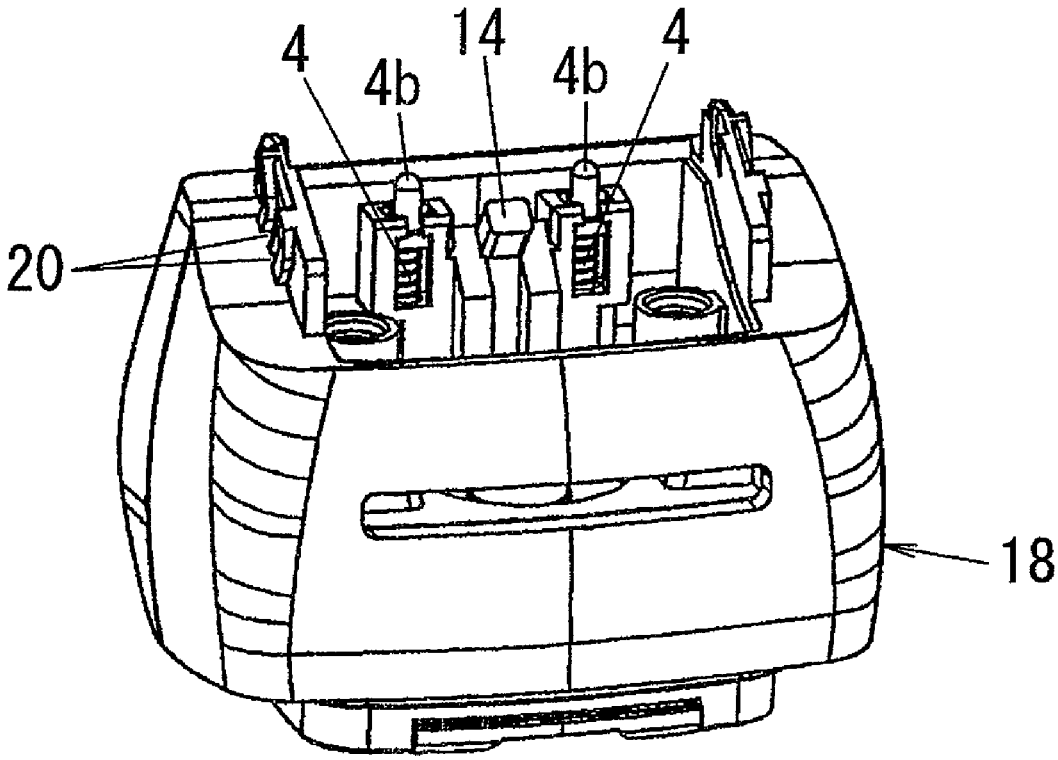
FIG. 17 is a perspective view showing a configuration of a blade holder with pressing springs of a hair clipper in accordance with a second embodiment of the present invention.
Figure 18:
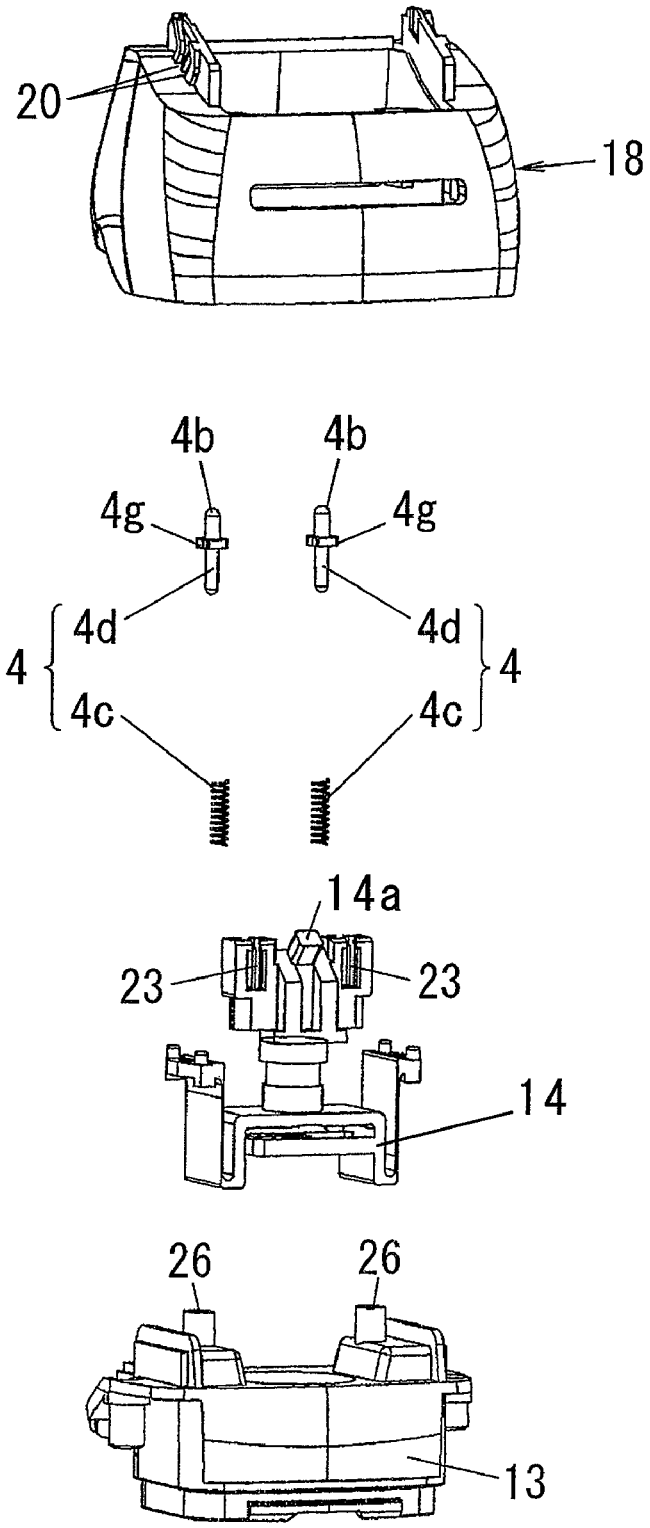
FIG. 18 is an exploded perspective view showing a configuration of the blade holder.
Figure 19:
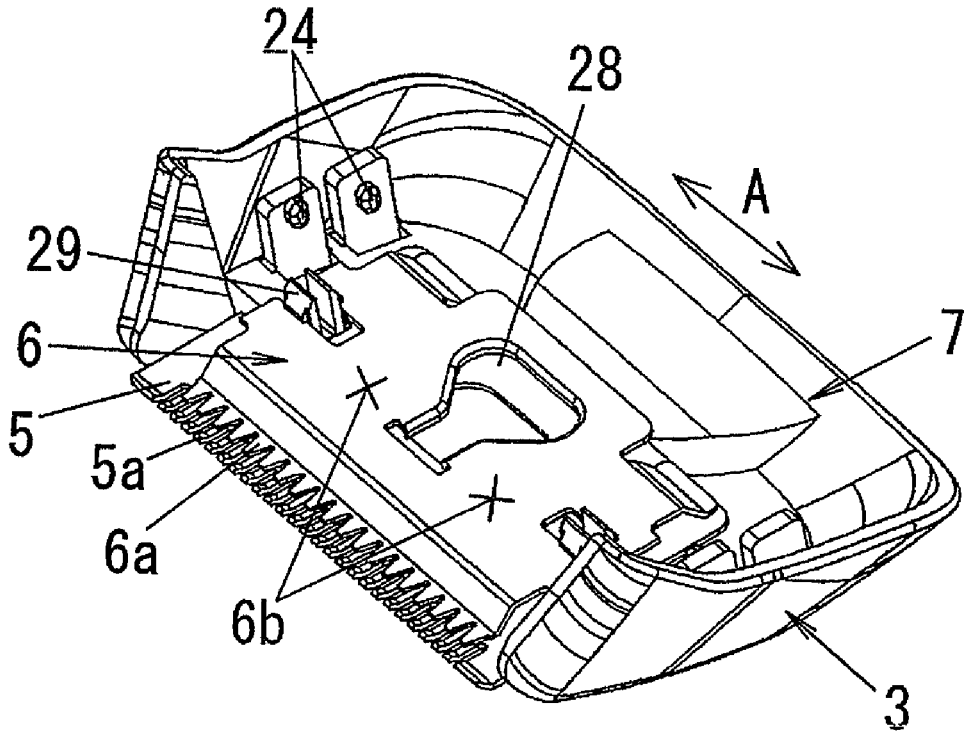
FIG. 19 is a perspective view showing a configuration of a bottom face side of the blade block in the second embodiment.
Figure 20:
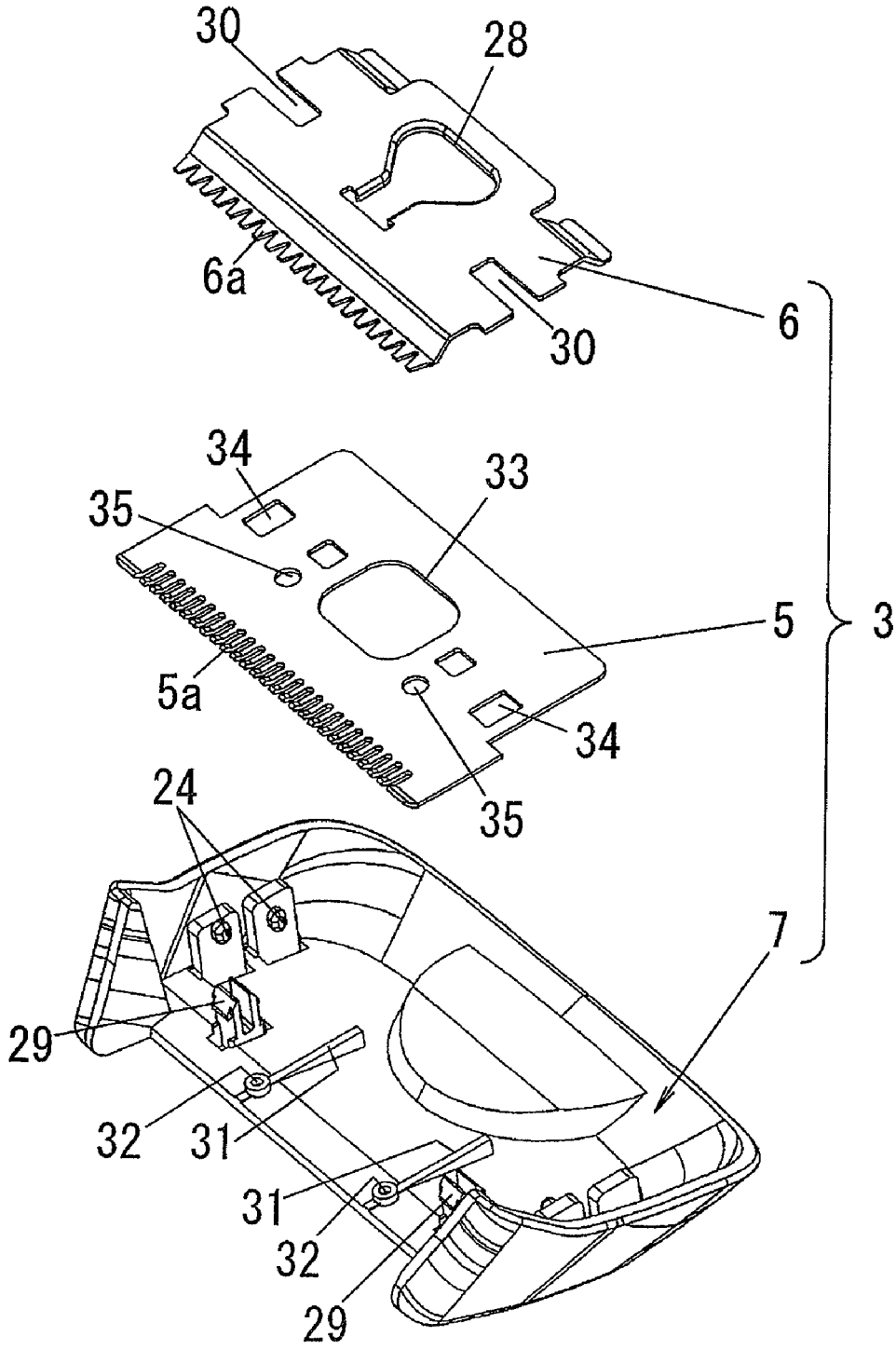
FIG. 20 is an exploded perspective view showing a configuration of the blade block in the second embodiment.

FIGS. 16A to 16C show a fourth example of the engaging portion 10 of the moving blade 6 and the contact portion 4*b* of the torsion spring 41 of the pressing mechanism 4. In the fourth example, an engaging member 50 is further provided integrally with the moving blade 6. Two pairs of guide walls 10*d* with a gap 10*c* are formed to protrude below in the vicinity of the front end of the engaging member 50. The width of the gap 10*c* is gradually narrowed proceeding to the front end of the engaging member 50. Thus, the guide walls 10*d* serves an the guide portion 11, and the narrowest portion of the gap 10*c*, that is the front end of the guide walls 10*d* serve as the engaging portion 10.

In an operation to attach the blade block 3 to the blade holder 18 of the main body 2 of the hair clipper 1, the contact portion 4*b* of the torsion spring 41 of the pressing mechanism 4 initially contacts the guide portion 11 of the moving blade 6 when the arm 4*f* of the torsion spring 4 is not bent. Subsequently, the contact portion 4*b* moves forward corresponding to the bending of the arm 4*f* and proceeds into the engaging portion 10. Since the width of the guide portion 11 is wider than that of the engaging portion 10 and the width of the guide portion 11 is gradually narrowed proceeding to the engaging portion 10, as shown in, for example, FIG. 11, the contact portion 4*b* of the torsion spring 41 of the pressing mechanism 4 is surely guided to and engaged with the engaging portion 10. Furthermore, since the engaging portions 10 of the moving blade 10 are formed near to the saw-teeth 6*a*, the front end portion, that is, the saw-teeth 6*a* of the moving blade 6 can be pressed toward the stationary blade 5 evenly with a predetermined pressure.

The sharpness of cutting of the blades is generated by maintaining the tolerance between the moving blade 6 and the stationary blade 5 in a predetermined level during the clipping of hairs. According to the configuration of the blade block 3 and the blade holder 18 as mentioned above, the contacting points of the contact portions 4*b* of the pressing mechanism 4 moves with the moving blade 6 when the moving blade 6 is reciprocally driven by the driving force of the motor 8 via the driving member 14, so that the pressure to press the moving blade 6 toward the stationary blade 5 becomes stable and substantially constant in the reciprocal motion of the moving blade 6. Thus, desired sharpness of cutting of the blades can be generated by selecting the pressure due to the pressing mechanism 4 properly.

In the first embodiment, the pressing mechanism 4 for pressing the moving blade 6 toward the stationary blade 5 is provided on the blade holder 18 of the main body 2 of the hair clipper 1, not on the blade block 3. Thus, the pressure to press the moving blade 6 toward the stationary blade 5 is not generated unless the blade block 3 is attached to the blade holder 18. In other words, neither a reaction force of the pressure from the moving blade 6 nor another tension act on the pressing mechanism 4 during the stock term, so that fatigue or deformation of the torsion spring 41 of the pressing mechanism 4 due to these unnecessary pressures may not occur even when the blade block 3 is stocked in a long term. In addition, since the moving blade 6 and the stationary blade 5 are not tightly contacted with each other with the pressure of the pressing spring, grease or lubrication oil spread on the surfaces of the blades is rarely hardened in the stock term, and thus, it is possible to prevent the problem that the moving blade 6 cannot be driven due to the load of the hardened grease or lubrication oil on start-up just after replacement of the blade block 3.

Furthermore, since the pressing mechanism 4 is not provided on the blade block 3, a number of elements that constitute the blade block 3 is decreased, and thus, cost reduction of the blade block 3 can be achieved, and the assemble workability of the blade block 3 is increased. Therefore, in the use of barber shop with high frequency of usage or in the medical use where the razor must be disposed essentially, it is possible to reduce the running cost of the replaceable blade block of the hair clipper.

Second Embodiment

A hair clipper having a replaceable blade block thereof in accordance with the second embodiment of the present invention are described with reference to FIGS. 17 to 20. In the second embodiment, the essential configuration of the hair clipper 1 is substantially the same as that in the first embodiment except the configuration of the pressing mechanism 4. Elements substantially the same as those in the first embodiment are designated by the same numerical references and the explanations of them are omitted.

In the second embodiment, the pressing mechanism 4 to press the moving blade 6 toward the stationary blade 5 is configured by two sets of a coil spring 4*c* and a pressing pin 4*d*. A pair of spring holders 23 is formed at both sides of an engaging portion 14*a* of the driving member 14 at the top end portion. The spring holder 23 has, for example, an insertion hole having a circular or a rectangular cross section, and the coil spring 4*c* is inserted into the insertion hole.

A flange 4*g* that contacts with an upper end of the coil spring 4*c* and receives the pressure of the coil spring 4*c* is formed at a center portion of the contact pin 4*d*. A lower portion of the contact pin 4*d* below the flange 4*g* is inserted into a center hollow of the coil spring 4*c*, so that the contact pin 4*d* always receives a pressure of the coil spring 4*c*, upwardly. A top end of the contact pin 4*d* is finished spherically so as to serve as the contact portion 4*b* of the pressing mechanism 4.

When the blade block 3 is attached to the blade holder 18 of the main body 2, the engaging portion 14*a* of the driving member 14 engages with the center engaging hole 28 of the moving blade 6, and the top ends (contact portion 4*b*) of the contact pins 4*d* contact to predetermined contact points 6*b* of the moving blade 6. Since the pressing mechanism 4 is provided on the driving member 14, even when the moving blade 6 is reciprocally driven by the driving force of the motor 8 through the driving member 14, the pressing mechanism 4 reciprocally moves in synchronism with the moving blade 6. In other words, the contact points 6*b* of the top ends of the contact pins 4*d* and the moving blade 6 never move.

According to the configuration of the second embodiment, the contact portions 4*b* of the pressing mechanism 4 are stationary with respect to the moving blade 6, so that sliding friction between the pressing mechanism 4 and the moving blade 6 never occurs. Thus, it is possible to prevent the galling and/or deformation of the contact pins 4*d* and the coil springs 4*c*. In addition, even when the moving blade 6 is reciprocally driven, the contact points 6*b* of the top ends of the contact pins 4*d* and the moving blade 6 never move, so that the pressure to press the moving blade 6 toward the stationary blade 5 becomes stable and even, and thus, desired sharpness of cutting of the blades can be maintained in a long term.

Furthermore, since the pressing mechanism 4 is provided on the moving member 14 in the second embodiment, it is possible to omit a specific element such as the head cover 19 in the first embodiment to hold the pressing mechanism 4. Although a number of elements that constitute the pressing mechanism 4 is increased, the shapes of respective elements such as the coil spring 4*c* and the contact pin 4*d* become simple, and a total number of elements that constitute the hair clipper 1 is rarely increased, in comparison with the above mentioned first embodiment. Still furthermore, it is no need to form the engaging portions 10 and the guide portions 11 on the moving blade 6, so that the mechanical strength of the moving blade 6 can be increased, in comparison with the first embodiment.

Since the present invention is not limited to the above mentioned configurations of the embodiments, it is sufficient that the hair clipper in accordance with an aspect of the present invention comprises: a blade block having a comb-shaped stationary blade and a comb-shaped moving blade which is reciprocally movable in a widthwise direction of the hair clipper; a main body having a motor and a driving member to transfer and to transmit a driving force of the motor to reciprocal motion of the moving blade, and to which the blade block is attached; and a pressing mechanism to press the moving blade toward the stationary blade, provided on the main body and having at least one contact portion which reciprocally moves in synchronism with a reciprocal motion of the moving blade.

According to such a configuration, since the pressing mechanism is provided on the main body not on the detachable blade block, a number of elements that constitute the replaceable blade block can be decreased, so that assemble workability of the blade block is increased and the cost of the blade block can be decreased. In particular, in the use of barber shop with high frequency of usage or in the medical use where the razor must be disposed essentially, it is possible to reduce the running cost of the replaceable blade block of the hair clipper. Furthermore, since the pressing mechanism is not provided on the blade block, even when the blade block is stocked in a long term, the sharpness of cutting of the blade is never be deteriorated due to fatigue or deformation of the pressing spring. Still furthermore, since the contact portion of the pressing mechanism reciprocally moves in synchronism with the reciprocal motion of the moving blade, the contact portion of the pressing mechanism rarely moves relative to the moving blade, and thus, slipping friction between the contact portion of the pressing mechanism and the moving blade rarely occurs. Consequently, galling or deformation of the element of the pressing mechanism rarely occurs, so that the pressing force of the pressing mechanism is maintained evenly. The sharpness of cutting of the blades becomes stable, and desired sharpness of the cutting blade can be obtained.

In the above mentioned configuration, it is preferable that the pressing mechanism includes a pair of torsion springs, and an end of an arm of each torsion spring serves as the contact portion and contacts with an engaging portion of the moving blade. According to such a configuration, although a winding portion of the torsion spring is held of the main body, an arm of the torsion spring can be bent following to the reciprocal motion of the moving blade, so that the contact portion of the pressing mechanism, for example, an end of the arm of the torsion spring rarely moves relative to the moving blade.

Furthermore, it is preferable that the engaging portions are arranged parallel to and in a vicinity of saw-teeth of the moving blade. According to such a configuration, the pressure of the torsion springs of the pressing mechanism can be applied to the moving blade evenly, so as to contact the saw-teeth of the moving blade tightly to the saw-teeth of the stationary blade, and thus, desired sharpness of cutting of blades can be obtained.

Still furthermore, it is desirable that a guide portion that guides the end of the arm to the engaging portion is further formed on the moving blade. Alternatively, it is preferable that the main body has a pair of positioning portions to position the arms of the torsion springs. According to such configurations, in an operation to attach the blade block to the main body, the contact portion of the torsion spring of the pressing mechanism can surely contact to the engaging portion of the moving blade.

Still furthermore, it is preferable that the end of the arm is finished spherically. According to such a configuration, even when the contact portion of the torsion spring moves a little relative to the moving blade, the contacting area between the contact portion of the torsion spring moves and the moving blade can be made minimum, and thus, the friction force generated between the contact portion of the torsion spring and the moving blade and the galling of the contact portion of the torsion spring can be minimized.

Alternatively, it is preferable that the pressing mechanism is provided on the driving member, and has two sets of a coil spring and a contact pin, which are arranged in the widthwise direction. According to such a configuration, since the pressing mechanism moves in synchronism with the reciprocal motion of the driving member and the moving blade, the contact portion of the pressing mechanism never moves relative to the moving blade, and thus, the friction force is never generated between the contact portion of the torsion spring and the moving blade and no galling of the contact portion of the torsion spring occurs.

Furthermore, it is preferable that a top end of each contact pin is finished spherically. According to such a configuration, the pressure of the coil springs of the pressing mechanism can be applied to the moving blade evenly.

This application is based on Japanese patent application 2006-167942 filed Jun. 16, 2006 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A hair clipper, comprising:

a main body having a motor;

a blade block having a comb-shaped stationary blade and a comb-shaped moving blade which is reciprocally movable in a widthwise direction of the hair clipper;

a driving member configured to transfer and to transmit a driving force of the motor to reciprocally move the moving blade;

a blade holder positioned at a top end portion of the main body to which the blade block is detachably attached;

a head cover provided at an upper end of the blade holder; and a pressing mechanism configured to press the moving blade toward the stationary blade and having at least one contact portion which reciprocally moves in synchronism with a reciprocal motion of the moving blade, and the pressing mechanism having a coupling portion held on and coupled to the head cover, wherein the head cover has a holder that holds the coupling portion of the pressing mechanism on a bottom face thereof and at least one opening through which the contact portion of the pressing mechanism protrudes.

2. The hair clipper in accordance with claim 1, wherein the engaging portions are arranged parallel to and in a vicinity of saw-teeth of the moving blade.

3. The hair clipper in accordance with claim 1, wherein a guide portion that guides the end of the arm to the engaging portion is further formed on the moving blade.

4. The hair clipper in accordance with claim 1, wherein the main body has a pair of positioning portions to position the arms of the torsion springs.

5. The hair clipper in accordance with claim 1, wherein the end of the arm comprises a spherical shape.

6. The hair clipper in accordance with claim 1, wherein the pressing mechanism is provided on the driving member, and has two sets of a coil spring and a contact pin, which are arranged in the widthwise direction.

7. The hair clipper in accordance with claim 6, wherein a top end of each contact pin comprises a spherical shape.

8. The hair clipper in accordance with claim 1, wherein the pressing mechanism includes a pair of torsion springs formed at opposing ends of the coupling portion, and an end of an arm of each torsion spring serves as the contact portion and contacts an engaging portion of the moving blade.

9. The hair clipper in accordance with claim 8, wherein a guide portion that guides the end of the arm to the engaging portion is further formed on the moving blade.

* * * * *